United States Patent [19]

Ibrahim

[11] 4,396,403

[45] Aug. 2, 1983

[54] LOADING RESISTANT COATED ABRASIVE

[75] Inventor: Mohamed M. Ibrahim, Ballston Lake, N.Y.

[73] Assignee: Norton Company, Worcester, Mass.

[21] Appl. No.: 417,005

[22] Filed: Sep. 13, 1982

Related U.S. Application Data

[63] Continuation-in-part of Ser. No. 291,205, Aug. 10, 1981, abandoned.

[51] Int. Cl.[3] ..... B24D 11/00

[52] U.S. Cl. ..... 51/295; 51/298

[58] Field of Search ..... 51/295, 298, 301

[56] References Cited

U.S. PATENT DOCUMENTS

| | | | |
|---|---|---|---|
| 2,768,886 | 10/1956 | Twombly | 51/295 |
| 2,983,593 | 5/1961 | Duke | 51/298 |
| 3,042,508 | 7/1962 | Haigis et al. | 51/295 |
| 3,043,673 | 7/1962 | Klein et al. | 51/298 |
| 3,089,763 | 5/1963 | Gladstone | 51/295 |
| 3,619,150 | 11/1971 | Rinker et al. | 51/295 |

FOREIGN PATENT DOCUMENTS

| | | | |
|---|---|---|---|
| 931767 | 8/1973 | Canada | 57/6 |

*Primary Examiner*—Donald E. Czaja
*Attorney, Agent, or Firm*—Frank S. Chow

[57] ABSTRACT

Loading resistant coated abrasives can be made without the need for a supersize coating of metal stearates or any other material by incorporating phosphoric acids, partial esters of such acids, amine salts of such acids and partial esters, and/or quarternary ammonium salts with at least one long substituent group into amino resin or glue sizing adhesives used during the manufacture of the coated abrasives. Loading resistance equal or superior to that achieved with conventional zinc stearate supersized products can be achieved in this way.

5 Claims, No Drawings

LOADING RESISTANT COATED ABRASIVE

CROSS REFERENCE TO RELATED APPLICATION

This application is a continuation-in-part of my copending application Ser. 291,205 filed Aug. 10, 1981, now abandoned.

BACKGROUND OF THE INVENTION

1. Field of the Invention

The present invention relates to those articles of manufacture known as coated abrasives, which consist of flexible backings to which are adhered a plurality of abrasive grit particles on at least one side. Coated abrasives are used primarily for the shaping, dimensioning, or surface finish alteration of other material objects known generally as workpieces. Small particles of material removed from the workpieces and/or shed from the coated abrasives during working are collectively called swarf. In many cases, the swarf tends wholly or partially to adhere to the surface of the coated abrasive, eventually loading or clogging its abrasive surfaces and rendering it unsuited for further use. The invention relates particularly to coated abrasives which are specially resistant to such failure by loading.

2. Description of the Prior Art

A common commercial practice for the manufacture of coated abrasives which resist loading in the sanding of paints, primers, wood sealer coats, and a wide variety of other finishing compositions used on workpieces is essentially that described in U.S. Pat. No. 2,768,886 to Twombly. This patent describes the preparation of coated abrasives which have a final grit-side surface coating of unfused metallic soaps applied, preferably from a dispersion of such soap in a volatile liquid. The application of this metallic soap is done as a separate coating step in addition to the normal making and sizing coating steps which are customarily used for achieving adherence of the abrasive grits to the backing. In some cases, it may be possible to prepare products with adequate properties without using a sizing adhesive. The need for an additional coating operation compared with most coated abrasives obviously imposes labor and material costs.

Since the publication of the Twombly Patent, there have been several other patents directed to other types of "third" coatings, i.e., coatings in addition to the two normal making and sizing ones, which would achieve loading-resistant coated abrasives. Examples include polyvinylacetate as disclosed in Canadian Pat. No. 931,767 to Greenwood, polytetrafluoroethene and mixtures thereof as disclosed in U.S. Pat. No. 3,042,508 to Haigis, and mixtures of thermosetting resins, elastomers, and metallic soaps as disclosed in U.S. Pat. No. 3,619,150 to Rinker et al.

U.S. Pat. No. 3,043,673 to Klein et al. teaches the use of oxy-containing compounds either in a third coat or in the conventional sizing coat of a coated abrasive, together with an exceptionally high ratio of binder adhesive to grain, as an effective means for increasing the resistance of coated abrasives to loading in the finishing of leather and similar materials. The oxy compounds specified in this patent are all neutral organic compounds not expected to ionize in water solution. U.S. Pat. No. 3,089,763 to Gladstone teaches the use of polyoxyalkylene compounds in the size of coated abrasives, and one of the objects stated is to reduce loading. However, the teaching of the Gladstone patent is restricted to sizing compositions in which the principal constituent is an amine-catalyzed phenolic resin.

SUMMARY OF THE INVENTION

It is a primary object of this invention to provide coated abrasives which are as resistant to loading as products with metallic soap third coats, but which do not require an actual third coating. Other objects will be apparent from the description below.

It has been found that loading resistance can be imparted to otherwise conventional coated abrasives having size coats containing glue or amino resins by the incorporation into the size of small amounts of specific chemical compounds and mixtures as hereinafter described. These additives are phosphoric and condensed phosphoric acids, partial esters of such acids, amine salts of such acids and partial esters, quarternary ammonium salts with at least one long alkyl substituent, and mixtures of two or more of the above. A preferred example additive is the salt of n-amyl diacid phosphate with 2-amino-2-methylpropanol. A typical example of a suitable quarternary ammonium salt additive is stearamidopropyl- -hydroxyethyldimethyl ammonium nitrate.

DESCRIPTION OF THE PREFERRED EMBODIMENTS

In the studies which led to this invention, use was made of conventional coated abrasive backings, maker adhesives, and abrasive grits. The invention is applicable to any such products containing any such constituents, including the full range of grit sizes of normal commercial practice, comprising at least those with numerical designation of size from 12 to 600 as defined by the ANSI standard B74.18-1977. As is known to those skilled in the art, suitable backings include but are not limited to papers of weights varying from 50–300 grams per square meter (gm/m$^2$), suitably prepared (finished) cloth of a wide variety of types, and vulcanized fiber. Grits can be synthetic fused alumina, silicon carbide, garnet, zirconia-alumina, emery, flint, or other materials, and maker adhesives can be film-forming starches, animal hide glue, amino resins, latex-borne elastomers, etc.

Example additives which have detectable effects in reducing loading when used in the size coat are listed in Table 1. These additives were most effective when used in amino resins such as urea-formaldehyde or melamine-formaldehyde resins. Such resins could be mixed in up to equal parts by weight with phenol-formaldehyde resins, one amino resin type could be mixed with one or more of the others, and any of the resins or mixtures could be filled with finely divided solids such as calcium sulfate, walnut shell flour, or any other of the well-known fillers used in the manufacture of coated abrasives. Suitable types of naturally derived glue, particularly animal hide glue, can also be used as the size coat, and the same additives will have a beneficial effect in reducing loading. Normally, the life of products made with glue sizes will not be as long as that of products made with resin sizes, as is also true in the absence of the additives disclosed here.

The cure of amino resins is accelerated by acid, and if phosphoric acids or their partial esters were added directly to the resins, decreased pot life would be expected. In order to avoid this effect, it is normally preferred to neutralize any acidic additive used in a separate operation before adding it to the resin-containing size adhesive. Such neutralization may be accomplished with a wide variety of amines, of which several examples are included in Table 1. The particular choice of amine appeared to have little effect on the loading resistance achieved. However, amine neutralizing agents were preferred to ammonia or alkalis such as sodium hydroxide. The neutralization may be accomplished by any conventional means, but I have found it most convenient to accomplish the neutralization by dissolving the acidic component in about half its own weight of water, then titrating with the neutralizing agent until a pH reading of 7 is obtained with pH meter electrodes immersed in the solution.

TABLE 1

EXAMPLES OF ADDITIVES WHICH IMPROVE LOADING RESISTANCE OF AMINO RESIN AND GLUE SIZING ADHESIVES FOR COATED ABRASIVES

| Identification Code | Primary Additive | Neutralizer Used | Trade Name, If Any, and Supplier |
|---|---|---|---|
| | First Group - Phosphoric Acids, Partial Esters, and Their Salts | | |
| E1 | n-butyl diacid phosphate | 2-amino-2-methyl-propanol (2AMP) | — |
| E2 | ethyl diacid phosphate | 2AMP | — |
| E3 | n-tridecyl diacid phosphate | 2AMP | — |
| E4 | n-octyl diacid phosphate | 2AMP | — |
| E5 | n-amyl diacid phosphate | 2AMP | — |
| E6 | mixture of approximately equals amounts of mono- and di-esters of phosphoric acid with a mixture of approximately equal amounts of n-octyl, n-decyl, and n-dodecyl alcohols | triethanolamine | Zelec NE or Zelec NK, du Pont |
| E7 | Same as for E6 | 2AMP | Zelec UN, duPont (for ester only) |
| E8 | Mixture of mono- and di-phosphate esters with alcohols which are oligomers of ethylene oxide | 2AMP | Monafax L-10, Mona Industries (for ester) |
| E9 | Same as E8 | 2AMP | Monafax 786 Mona Industries (for ester) |
| E10 | Same as E8 | 2AMP | Monafax 785 (remainder as for E8) |
| E11 | Same as E8 | 2AMP | Monafax H-15 (remainder as for E8) |
| E12 | "Complex organic phosphate esters" | 2AMP | Emphos PS-400, Witco Chemical Co. |
| E13 | ethyldiacid phosphate | triethanolamine | — |
| E14 | n-butyldiacid phosphate | triethanolamine | — |
| E15 | n-octlydiacid phosphate | triethanolamine | — |
| E16 | di(n-butyl)acid phosphate | 2AMP | — |
| E17 | di(n-butyl)triacidpyro-phosphate | n-octyl amine | — |
| E18 | Same as E17 | 2-ethyl-4-methyl-imidazole | — |
| E19 | Same as E17 | di(n-butyl)amine | — |
| E20 | Same as E17 | diethylethanol-amine | — |
| | Second Group - Quarternary Ammonium Salts (tetraorganyl ammonium salts) | | |
| Q1 | stearamidopropyl- -hydroxy-ethyldimethylammonium di-hydrogen phosphate | none | Cyastat SP, American Cyanamid |
| Q2 | stearamidopropyl- -hydroxy-ethyldimethylammonium nitrate | none | Cyastat SN, American Cyanamid |
| Q3 | dimethyly-diallyl ammonium chloride (mixed with methylolacrylamide) | none | E-1373, Calgon Corp. |

In order for the additives of my invention to function properly, they must be soluble or freely dispersible in the adhesive solutions or dispersions as coated. In the remainder of this specification, the term "soluble" or its derivatives will be used to include any material which forms a stable and macroscopically homogeneous mixture when stirred into the solute involved; in other words, no distinction is made between "true solutions" which have optical clarity and "dispersions" which show cloudiness or opalescence, provided that the material described as soluble does not sink or float to a visually observable degree within a few hours after mixing.

In order to promote solubility, it is normally preferred that the additives used contain no substituent groups which have more than sixteen carbon atoms in a straight chain. Thus lauryl or dilauryl phosphate would be expected to be satisfactory, while cetyl phosphate would be expected to be insoluble. However, if many polar bonds are present in the substituent group(s), longer group(s) could be satisfactory.

If the partial ester used has marginal solubility, a multioxyamine such as diethanolamine or triethanolamine may be preferable for neutralization in order to promote solubility.

Still other conventionally known materials, such as pigments and dyes, diluents for reducing viscosity, antifoam agents, etc. may be used together with the additives of this invention when needed or desired for any of the reasons known in the art. A particularly important class of conventional components in amino resin adhesive formulations are the oxyamines useful for craze resistance as taught by Duke in U.S. Pat. No. 2,983,593, the entire specification of which is hereby incorporated herein by reference. Use of adhesive compositions as taught in this reference by Duke, in combination with the additives of my invention, is preferred. When so used, the resin adhesive with my additive can be cured with same time and temperature program as is useful for the same resin composition without the additive. Unless a different amine is needed to promote solubility as noted above, it is most convenient to use one of the oxyamines taught by Duke to neutralize any residual acidity of any acidic component of my additives.

Except for the modification of the adhesive composition by the additives of my invention, all other steps of the manufacture of a coated abrasive according to my invention may be carried out in a manner which is conventional for manufacturing such products without any third coating on the grain side of the product.

The minimum amount of additive to give a useful loading resistance effect was found to be that corresponding to a mass of 0.7 gm/m$^2$, with only the material(s) shown as the "primary additive" and "neutralizer used" in Table 1 counted as part of this mass. An amount more than 10% by weight of the total sizing adhesive used is generally not desirable, because of probable decrease in the heat-distortion resistance of the sizing adhesive, with resultant danger of reduction of grinding effectiveness. In general, the workable range of additive is from 0.7 to 13 gm/m$^2$, and the preferable range is from 1.2 to 3.5 gm/m$^2$. This can conveniently be achieved in most cases by using the additive at a level of 3–5% by weight of the resin or glue sizing adhesive used.

There was no visual evidence during processing of any tendency of the adhesive mixtures containing the additives to develop inhomogeneities under normal conditions of coating, drying, or cure. However, it is expected from the chemical nature of at least some of the additives that they will reduce the surface tension of most water-based liquid adhesives into which they are mixed. If such reduction in surface tension actually occurs, the well-known Gibbs equation for such surface active species predicts that the surface active component(s) will spontaneously distribute themselves at equilibrium so as to form a surface layer enriched in the surface active component(s). Such a concentration of additive in the surface layer may explain why the minimum amount of additive required to obtain a detectable increase in loading resistance was found to be related to the area of the coated abrasive product rather than to the volume of adhesive.

Size height levels for products coated with sizes containing the additives taught herein should generally conform to those for conventional products which are not to receive an additional third coating. In any case, suitable levels can easily be determined if necessary by those skilled in the art of manufacturing coated abrasives.

Table 2 illustrates some non-limiting examples of specific products prepared according to the methods of this invention. In general, the additives of the first group of Table 1 gave products with greater loading resistance and are therefore preferred.

In this specification and in the claims below, the term "organyl" is used to include any chemical group which could be formed by the breaking of one valence bond in an organic compound. Thus organyl includes the groups normally designated as alkyl, alkenyl, alkynyl, aryl such as phenyl, and combinations of and substitutions on the other simple groups, as well as a wide variety of others. The term "long organyl" refers to an organyl group which comprises at least eight carbon atoms bonded linearly to each other in a chain. The linear bonding may include double or triple as well as single carbon-carbon bonds. Typically such a group will have a chain of from eight to twenty atoms.

TABLE 2

SPECIFIC EXAMPLES OF LOADING RESISTANT COATED ABRASIVES

| | Maker Adhesive | | Abrasive Grits | | | Sizing Adhesive | | | |
|---|---|---|---|---|---|---|---|---|---|
| | | | | Grit | | Total | Main | Additive | |
| Backing | Type | Gm/m$^2$ | Type | Size | Gm/m$^2$ | Gm/m$^2$ | Type | Code | Gm/m$^2$ |
| B1 | M1 | 15 | G1 | 120 | 138 | 77 | S1 | E1 | 3.1 |
| B1 | M2 | 22 | G1 | 180 | 53 | 30 | S1 | E17 | 1.5 |
| B1 | M1 | 15 | G1 | 360 | 44 | 30 | S1 | E6 | 1.2 |
| B1 | M1 | 15 | G2 | 320 | 44 | 30 | S1 | E8 | 1.2 |
| B1 | M1 | 19 | G3 | 220 | 77 | 62 | S1 | E6 | 2.5 |
| B1 | M2 | 12 | G4 | 220 | 40 | 30 | S1 | E7 | 1.2 |
| B2 | M1 | 22 | G2 | 180 | 98 | 62 | S1 | E10 | 2.5 |
| B1 | M1 | 22 | G5 | 180 | 53 | 30 | S2 | E9 | 1.2 |
| B3 | M3 | 118 | G6 | 80 | 129 | 133 | S2 | Q2 | 5.3 |
| B1 | M1 | 26 | G1 | 120 | 138 | 77 | S3 | E12 | 3.1 |

TABLE 2-continued

SPECIFIC EXAMPLES OF LOADING RESISTANT COATED ABRASIVES

| | Maker Adhesive | | Abrasive Grits Grit | | | Sizing Adhesive Total | Main | Additive | |
|---|---|---|---|---|---|---|---|---|---|
| Backing | Type | Gm/m² | Type | Size | Gm/m² | Gm/m² | Type | Code | Gm/m² |
| B4 | M1 | 56 | G1 | 220 | 115 | 81 | S1 | Q3 | 3.3 |

Symbol Keys for Table 2

Gm/m² indicates dried grams of item indicated per square meter of coated abrasive. Sizing adhesive additive Codes are from Table 1.

Backings: B1 is 68 gm/m² kraft paper (Style 28729 from Kimberly-Clark); B2 is slightly heavier kraft paper (Style 54729 from Kimberly-Clark); B3 is 130 pound basis weight (220 gm/m²) N cylinder paper (James River); B4 is cotton jeans cloth finish 207AA from Norton Company.

Makers: M1 is 82 millipoise animal glue; M2 is Ucar 131 latex from Union Carbide; M3 is urea-formaldehyde resin GPX-J1-6 from Georgia-Pacific.

Abrasive Grits: G1 is type SWPL alumina from Treibacher USA, Inc.; G2 is type FRPL from Treibacher; G3 is type 57 Alundum from Norton Co., G4 is garnet from Barton Mines; G5 is silicon carbide from Norton Co.; G6 is a mixture of type 57 Alundum and NZ Alundum from Norton Co. in a volume ratio of 6:4.

Sizer Adhesives: S1 is urea-formaldehyde resin type Beetle 7238-20 from American Cyanamid; S2 is urea-formaldehyde resin type GPX-J1-6 from Georgia-Pacific; S3 is a mixture of Beetle 7238-20 and phenol-formaldehyde resin 2535 from Varcum Chemical Co., in equal proportions by weight.

The term layer in the description of a body of adhesive material is to be considered to include any substantially continuous body of material of substantially uniform composition, with projected area covering substantially all the area of a coated abrasive backing. Because of the presence of abrasive grit particles in a coated abrasive, the layers of adhesive used in the manufacture thereof are expected to have very irregular outer surfaces rather than the smooth parallel surfaces normally suggested by the word layer in ordinary usage. An an example, the maker and sizer coats used in the normal manufacturing process for a coated abrasive would constitute layers in the finished product, as would any separate coat of metallic soap intended to confer loading resistance. It should be further noted that substantial uniformity of composition of an adhesive layer is intended to include any natural surface enrichment of a surface active material incorporated into the adhesive layer when it is applied in liquid form. Also, substantial continuity of an adhesive layer is not violated by the presence of normal flex cracks in a coated abrasive.

I claim:

1. In a coated abrasive comprising a flexible backing, a plurality of abrasive grit particles dispersed over the area of at least one surface of said backing, and at least one layer of adhesive bond material adhering said abrasive grit particle to each other and to said backing, the improvement wherein the outermost layer of said adhesive bond material comprises:

(1) animal glue, or a cured amino resin, or mixtures therof in an amount of at least 40% by weight of the total adhesive bond material in said outermost layer, exclusive of any filler; and (2) from 0.7 to 13 grams per square meter of the grit-covered surface of said coated abrasive of an additive soluble in the liquid from which the adhesive of part (1) was coated during the process of manufacture of said coated abrasive, said additive being selected from the group consisting of (a) phosphoric and condensed phosphoric acids and partial esters thereof, (b) amine salts of the acids in part (a), (c) tetraorganyl ammonium salts having at least one long organyl group containing at least eight carbon atoms, and (d) mixtures thereof.

2. A coated abrasive as in claim 1, wherein the amount of (2) said additive is between 1.2 and 5.3 grams per square meter of abrasive covered surface of said coated abrasive.

3. A coated abrasive as in claim 1, wherein the outermost layer of adhesive bond material comprises:

(1) cured urea-formaldehyde resin in an amount of at least 40% by weight of the total of said adhesive bond layer, exclusive of any filler, and (2) the residue after curing of a latent curing system consisting essentially of:

(a) an ammonium salt of an acid having a dissociation constant of at least $10^{-4}$, and (b) an amino compound having at least one primary amino group attached to a teritiary carbon atom and having a hydroxyl or ether oxygen atom adjacent said tertiary carbon atom, said amino compound being present in a quantity sufficient to raise the pH of the total adhesive composition to a value of from 6 to 9 prior to cure of the adhesive.

4. A coated abrasive as in claim 3, wherein said amino compound is 2-amino-2-methyl propanol, 2-amino-2-methyl-1,3-propanediol, 5-amino-5-methyl-1,3-dioxane, tris(hydroxymethyl) aminoethane, or 2-amino-2-ethyl-1,3-propanediol.

5. A coated abrasive as in any of claims 1, 2, 3, or 4, wherein said additive is selected from the group consisting of salts of (1) acids selected from the group consisting of (a) monoesters and diesters of orthophosphoric acid with primary alcohols having from 2–16 carbon atoms per molecule and (b) pyrophosphoric acid and (2) amines selected from the group consisting of (a) primary, secondary, and tertiary alkyl, hydroxyalkyl, and mixed alkyl and hydroxyalkyl amines in which all alkyl and hydroxyalkyl groups have from 2 to 8 carbon atoms per group, (b) amino compounds having at least one primary amino group attached to a tertiary carbon atom and having a hydroxyl or ether oxygen atom attached to a second carbon atom adjacent said tertiary carbon atom, and (c) imidazole and substituted imidazoles.

* * * * *